US006814657B2

(12) United States Patent
Spangenberg et al.

(10) Patent No.: US 6,814,657 B2
(45) Date of Patent: Nov. 9, 2004

(54) GRINDING WHEEL WITH GRINDING MEMBERS

(75) Inventors: Rolf Spangenberg, Gauting (DE); Oliver Ohlendorf, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/319,220

(22) Filed: Dec. 13, 2002

(65) Prior Publication Data

US 2003/0139128 A1 Jul. 24, 2003

(30) Foreign Application Priority Data

Dec. 17, 2001 (DE) ..... 101 61 931

(51) Int. Cl.[7] ..... B23F 21/03
(52) U.S. Cl. ..... 451/548; 451/488; 451/540
(58) Field of Search ..... 451/548, 540, 451/549, 550, 488

(56) References Cited

U.S. PATENT DOCUMENTS 5,911,620 A 6/1999 Spangenberg et al.
6,299,522 B1 * 10/2001 Lee ..... 451/548
D463,965 S * 10/2002 Lee et al. ..... D8/70
D474,954 S * 5/2003 Kim et al. ..... D8/70
D477,207 S * 7/2003 Kim et al. ..... D8/70

FOREIGN PATENT DOCUMENTS

DE 0105199 9/2002
EP 1074347 2/2001

* cited by examiner

*Primary Examiner*—George Nguyen
(74) *Attorney, Agent, or Firm*—Sidley Austin Brown & Wood, LLP

(57) ABSTRACT

A grinding wheel has a flat, circular carrier surface (1) on which a plurality of elongated grinding members (2) are arranged running least partially radially. A discharge opening (3) is disposed ahead of each of the grinding members (2) in the circumferential direction (U). Furthermore, the carrier surface (1) has a basically truncated conical central depression (4) facing away from the grinding members (2). The discharge openings (3) abut the L-shaped grinding members (2) in a direction of rotation (D) and extend approximately over the entire length of the grinding members (2).

7 Claims, 1 Drawing Sheet b1
b2
2
3
U
6
7
4
L2
L1
5
8
L
II
D
1

(II - II)
7
6
3
4
8
2
1

GRINDING WHEEL WITH GRINDING MEMBERS

BACKGROUND OF THE INVENTION

The invention relates to a grinding wheel with a flat, circular carrier surface on which a plurality of elongated grinding members are arranged running at least partially radially, wherein at least one discharge opening is arranged ahead of the grinding members in the circumferential rotational direction and the carrier surface has a centrally truncated conical depression extending from the grinding members.

Grinding wheels of the type described above are used for working the surface of a workpiece. The circular grinding wheel is, for example, driven by an electrical motor and removes particles, in particular dust particles, from its surface by means of grinding members arranged on a carrier surface. The grinding members are formed of diamond particles, for example, so that adequate hardness is provided for working a concrete surface. In order to at least partially prevent contamination of an environment by the particles removed, the carrier surface has at least discharge opening arranged ahead of the grinding members in the rotational direction. The discharge openings serve in discharging the particles, for example, by means of a low-pressure source connected to the discharge openings by a conduit. The carrier surface has a centrally basically truncated conical depression facing away from the grinding member, in order to fasten the grinding wheel to, for example, a motor driven drive spindle.

U.S. Pat. No. 6,299,522 B1 discloses a grinding wheel comprising a flat, circular carrier surface on which a plurality of elongated grinding tips are arranged and run at least partially substantially radially. A discharge opening is disposed ahead of the grinding tips in the circumferential direction and the carrier surface has a central circumferential truncated conical depression that faces away from the grinding tips. The grinding tips run essentially in the circumferential direction, whereby the discharge openings are disposed in a radial zone adjacent to the grinding tips.

The drawback in the known solution is that the discharge openings assure only insufficient suction performance in the area of the grinding tips.

SUMMARY OF THE INVENTION

The object of the present invention is to provide a grinding wheel with grinding members that assures sufficient suction performance.

The object is essentially achieved according to the invention in that the discharge openings abut the grinding members in the direction of rotation and approximately over the entire length of the grinding members.

As a result of the fact that the discharge openings extend substantially over the overall length of the grinding members, the particles removed are carried off directly at the grinding members. A discharge opening can, for example, be configured in a plurality of parts in order to assure a higher degree of stability in the grinding wheel. Preferably the discharge openings extend over 75% to 100% of the length of the adjacent grinding members.

The discharge openings advantageously have a first width running in the circumferential direction and the grinding members have a second width running in the circumferential direction, whereby with corresponding grinding members and discharge openings the first width corresponds essentially with the second width. By using this dimensioning of the discharge openings as a factor of the grinding members, optimal discharge of the particles removed by the grinding wheel is assured.

The grinding members are preferably arranged in combination substantially in an L-shape with a longitudinal extension in the circumferential direction essentially abutting on the radial longitudinal extension in order to avoid escape of the removed particles radially outwards over the external circumference of the grinding wheel.

Advantageously, the discharge openings are formed substantially in the shape of an L.

Preferably, the discharge openings each have a section that runs in the circumferential direction in order to assure in this fashion, especially radially outwards, sufficient suction performance.

BRIEF DESCRIPTION OF THE DRAWINGS

The invention will be more completely explained below using an exemplary embodiment, wherein.

DETAILED DESCRIPTION OF THE PREFERRED EMBODIMENTS

Figure 1:
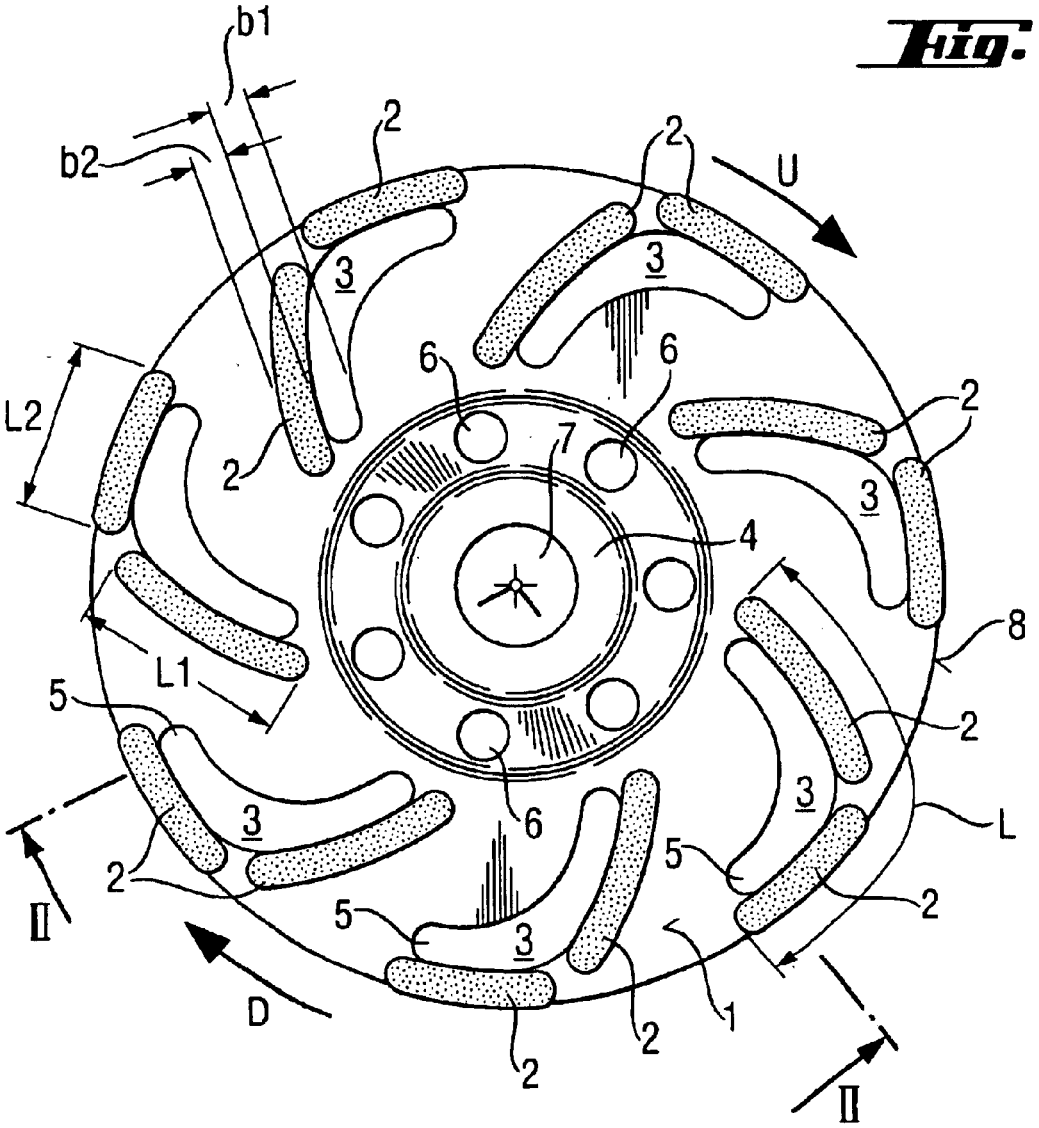
FIG. 1 is a bottom view of a grinding wheel according to the invention.
Figure 2:
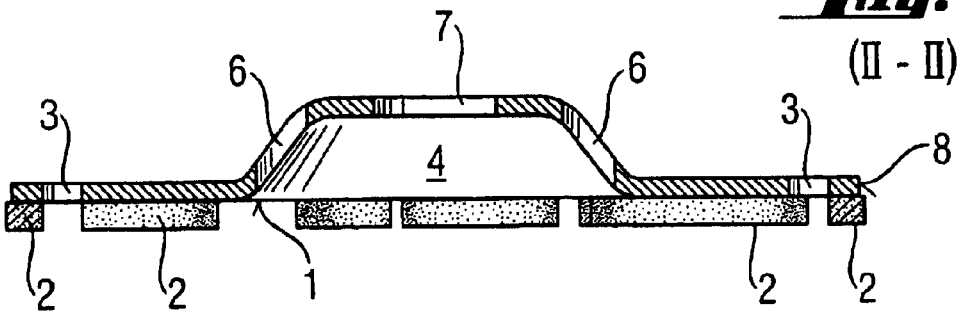
FIG. 2 is a cross-section along the line II—II of the grinding wheel shown in FIG. 1.

FIGS. 1 and 2 represent a grinding wheel according to the invention having a planar or flat, circular carrier surface 1 on which a plurality of elongated grinding members 2 are arranged running at least partially substantially radially. The grinding wheel has a central axis with the carrier surface spaced radially outward from the axis. A discharge opening 3 is disposed ahead of each of the combination of grinding members 2 in the circumferential direction U. Furthermore, the carrier surface 1 has a centrally arranged substantially truncated conical depression 4 facing away from the grinding members 2, as can be seen particularly in FIG. 2.

The discharge openings 3 abut in the direction of rotation D on the combination or pair of L-shaped grinding members 2 and extend approximately over the entire length L of the grinding members 2. Furthermore, the discharge openings 3 have a first width b1 running in the peripheral direction U and the grinding members 2 have a second width b2 running in the circumferential direction U, whereby in the case of corresponding grinding members 2 and discharge openings 3, the first width b1 corresponds basically with the second width b2.

The grinding members 2 have a longitudinal extension L2 extending essentially in the circumferential direction U abutting the radial extending longitudinal extension L1. The overall length L of the grinding members 2 corresponds in this arrangement to L1+L2. In order to assure optimal suction, the discharge openings 3 are basically, as in the case of the grinding members 2, formed L-shaped and each exhibit a section 5 that runs in the circumferential direction U.

The depression 4 has a plurality of through holes running radially relative to the carrier surface 1. Furthermore, the depression 4 has a receiving hole 7 running transversely to the carrier surface 1 and centrally relative to the axis of the depression 4 for fastening the grinding wheel to a motor driven drive spindle (not shown).

The grinding members 2 are arranged in two parts from diamonds and arranged in pairs. Of course, other hard materials are also appropriate for manufacturing the grinding wheel, including hard metal, PCD or the like. In a further embodiment (not shown) the grinding members 2 are formed in one piece. The grinding members 2 comprise a substantially rectangular cross-section. The inner or radially extending grinding members 2 are inclined approximately at a 45° angle relative to the diameter.

The portion of the grinding members 2 disposed in the circumferential direction U is disposed at the circumferentially extending radially outside edge 8 of the carrier surface 1.

What is claimed is:

1. A grinding wheel has a central axis, said grinding wheel has a planar circular carrier surface (1) extending radially inwardly from an outer circumferential edge (8) and arranged generally perpendicular to the central axis, a plurality of elongated grinding members (2) secured on and extending at least partially radially on said planar circular carrier surface a plurality of discharge openings (3) in said carrier surface (1) and located inwardly adjacent said elongated grinding members (2) in a rotation direction (D), said carrier surface has a truncated depression (4) radially inwardly of said grinding members (2) and discharge openings (3) and projecting in the axial direction away from said grinding members (2), said discharge openings (3) abuts said elongated grinding member ( 2) in the rotation direction (D) and extend approximately along a total length of said elongated grinding member (2).

2. A grinding wheel, as set forth in claim 1, wherein said discharge openings (3) have a first width (b1) extending in a circumferentially extending direction (U) and the grinding members (2) have a second width (b2) extending in the circumferentially extending direction (U) and in corresponding discharge openings (3) and grinding members (2) the first width (b1) corresponds substantially with the second width (b2).

3. A grinding wheel, as set forth in claim 2, wherein said grinding members are arranged in pairs one extending in the circumferentially extending direction (U) and the other extending generally radially inwardly and forming in combination an L-shaped arrangement with the circumferentially extending grinding member (2) having a long dimension extending in the circumferentially extending direction and closely arranged relative to the generally radially inwardly extending grinding member (2).

4. A grinding wheel, as set forth in claim 3, wherein each said pair of grinding elements (2) has a corresponding L-shaped discharge opening (3).

5. A grinding wheel, as set forth in claim 4, wherein each said discharge opening (3) has a first section (5) extending in the circumferentially extending direction (U).

6. A grinding wheel, as set forth in claim 5, wherein each said discharge opening (3) has a second section extending generally radially inwardly from said first section (5).

7. A grinding wheel, as set forth in claim 2, wherein each said discharge opening (3) is L-shaped and has a single L-shaped grinding member (2) adjacent thereto.

* * * * *